US005248105A

United States Patent [19]

Cooker

[11] Patent Number: 5,248,105

[45] Date of Patent: Sep. 28, 1993

[54] TOILET PAPER APPLIANCE

[76] Inventor: John T. Cooker, 220 S. Nashville Ave., Tucson, Ariz. 85747

[21] Appl. No.: 871,052

[22] Filed: Apr. 20, 1992

[51] Int. Cl.[5] ..... A47K 10/24

[52] U.S. Cl. ..... 242/55.2; D6/519; D6/523

[58] Field of Search ..... 242/55.2, 55.53, 55.3, 242/55.42, 55.54, 55.55; D6/518, 519, 520, 521, 522, 523, 569, 570, 574; 312/34.8, 34.22; 211/6, 16, 70.1, 90, 153

[56] References Cited

U.S. PATENT DOCUMENTS

| | | | |
|---|---|---|---|
| D. 162,122 | 2/1951 | Broeren | D6/518 |
| D. 174,682 | 5/1955 | Delaney | D6/519 |
| D. 184,049 | 12/1958 | Gillard | D6/519 |
| D. 238,463 | 1/1976 | Bauman | D6/521 |
| D. 238,465 | 1/1976 | Bauman | D6/521 |
| D. 267,607 | 1/1983 | Peabody et al. | D6/570 |
| D. 305,488 | 1/1990 | Korpijaako | D6/523 |
| D. 308,612 | 6/1990 | Cuevas | D6/523 |
| 1,336,140 | 4/1920 | Howard | 312/34.22 |
| 2,025,732 | 12/1935 | Dodelin | 242/55.3 |
| 2,702,672 | 2/1955 | Bonsignore | 242/55.3 |
| 3,482,796 | 12/1969 | Tucker . | |
| 3,799,467 | 3/1974 | Bauman . | |
| 3,943,859 | 3/1976 | Boone . | |
| 4,483,491 | 11/1984 | Rainey . | |

FOREIGN PATENT DOCUMENTS

| | | | |
|---|---|---|---|
| 0888012 | 1/1962 | United Kingdom | 312/34.22 |

OTHER PUBLICATIONS

House of Hospitality Adv., House Beutiful, May 1949 p. 81.

*Primary Examiner*—Thomas B. Will

*Attorney, Agent, or Firm*—Richard C. Litman

[57] ABSTRACT

A toilet paper appliance for keeping printed materials and other articles off of the floor. The appliance has a horizontal shelf and a newspaper rack, both joined to a vertical support member. The vertical support member can be placed between a pair of forwardly extending arm members of a toilet paper dispenser to combine the appliance with a dispenser. To mount the appliance to a wall, the vertical member has holes therein for screws to pass through. The appliance can include vertical hangers to support a roll of toilet paper and eliminate the need for a separate paper dispenser.

15 Claims, 2 Drawing Sheets

TOILET PAPER APPLIANCE

FIELD OF THE INVENTION

The present invention relates generally to article dispensing devices and, in particular, to a shelf and rack unit incorporated into a toilet paper dispenser.

BACKGROUND OF THE INVENTION

Bathrooms often lack clearly defined areas for the temporary placement of personal articles. Storage cabinets therein rapidly become filled with toiletries, medicines and the like, preventing the addition of further items. Frequently, newspapers and magazines carried into the room must be placed on the floor subjecting them to potential damage. Therefore, a need exists for a shelf and rack unit providing easily accessible storage for reading materials and other personal items such as a cup of coffee and an ashtray.

In the past, others confronted with this problem of a lack of bathroom storage space have incorporated shelves into toilet paper dispensers. U.S. Pat. No. 3,799,467 issued Mar. 26, 1974 to Arthur E. Bauman discloses a toilet paper holder having a horizontal shelf situated below a cradle for supporting a roll of toilet paper. The holder attaches to a toilet tank by a hook at its upper end. U.S. Pat. No. 3,482,796 issued Dec. 9, 1969 to Roy C. Tucker discloses a toilet paper holding device which has a shelf for holding a box of tissues or other articles. A dowel attached to a singular vertical support holds the roll of toilet paper. No means are provided therein for retaining bulky objects such as newspapers or magazines. U.S. Pat. No. 4,483,491 issued Nov. 20, 1984 to James R. Rainey discloses a similar device having grooved side panels. The side panels are incapable of positively locking the spindle, and consequently the paper roll, in place. Again, no provision is made for the retention of bulky printed materials. Finally, U.S. Pat. No. 3,943,859 issued Mar. 16, 1976 to Philip Boone discloses a small shelf having a fold down lid which is mountable upon a conventional toilet paper dispenser. The shelf's small size limits its storage capacity.

None of the above inventions and patents, taken either singly or in combination, is seen to describe the instant invention as claimed.

SUMMARY OF THE INVENTION

By the present invention, an easily installed toilet paper appliance is disclosed which provides a convenient shelf and newspaper rack within favorable reach of a commode. Accordingly, it is the principal object of the invention to provide a wall mountable toilet paper appliance having a horizontal shelf and newspaper rack.

It is another object of the invention to provide an appliance having a horizontal shelf and vertically offset newspaper rack capable of dispensing toilet paper or of being integrated into a previously existing toilet paper dispensing unit.

It is a further object of the invention to provide a sturdy toilet paper appliance which provides storage space without interfering with the normal dispensing of a roll of toilet paper.

It is an object of the invention to provide improved elements and arrangements thereof in a toilet paper appliance for the purposes described herein which is inexpensive, dependable and fully effective in accomplishing its intended purposes.

These and other objects of the instant toilet paper appliance will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
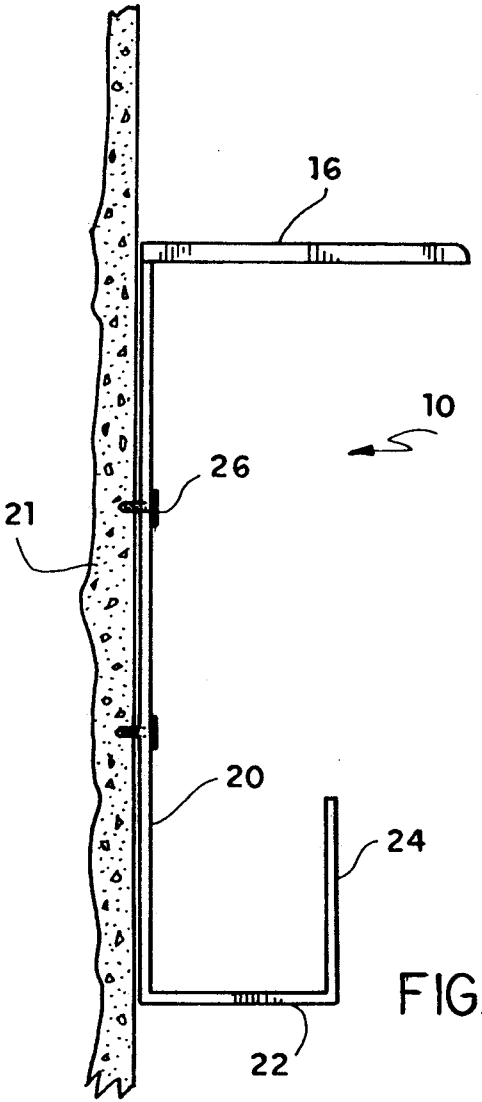
FIG. 2 is a side view of the invention shown in FIG. 1 showing the toilet paper appliance fastened to a wall.
Figure 1:
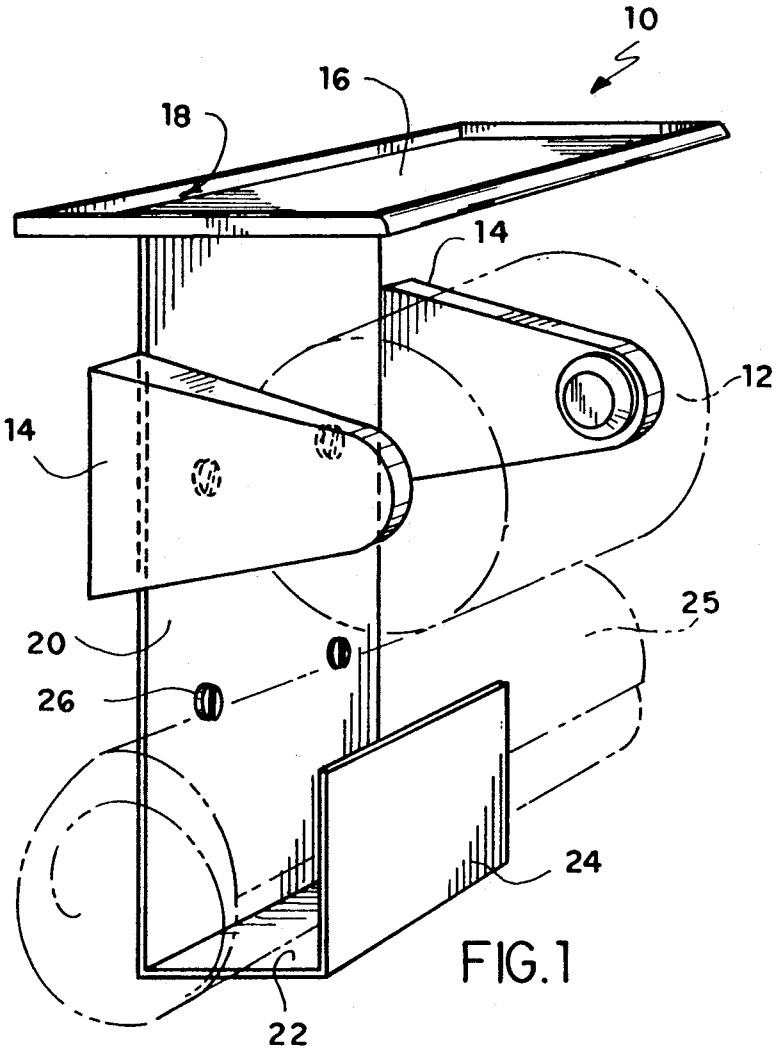
FIG. 1 is an environmental perspective view of a toilet paper appliance in accordance with the present invention installed within a conventional toilet paper dispenser.

The present invention is a toilet paper appliance. Referring to the drawings in greater detail, FIG. 1 illustrates appliance 10 installed behind a roll of toilet paper 12 mounted on two posts of a toilet paper holder or dispenser 14. Appliance 10 has a four-sided horizontal shelf 16 which may be used to store toiletries or support other personal articles. The shelf 16 has a raised bead 18 to prevent objects placed there upon from falling off. Exterior surfaces of the raised beads 18 can be curved to eliminate pointed edges to prevent potential injury. Attached at a right angle to the underside of shelf 16 is vertical support member 20 having spaced openings through which screws 26 may be inserted to join appliance 10 to wall surface 21. Although screws 26 are shown in FIGS. 1 and 2, it is contemplated that other types of fasteners can be used, such as nails, bolts or the like.

Connected to support member 20 is a newspaper rack formed by horizontal member 22 and vertical retainer 24. Vertical retainer 24 has a height sufficient to retain rolled up newspaper 25. The vertical member 20 is of sufficient height to accommodate paper roll 12 such that it may freely rotate without interference from inserted newspaper 25 or shelf 16. While FIG. 1 shows a newspaper in the rack area of appliance 10, other types of reading materials may also be placed therein, such as magazines, pamphlets or books.

To install appliance 10, the toilet paper dispenser 14, shown in FIG. 1, is first freed of the paper roll 12. Then vertical support member 20 is situated between the two posts of dispenser 14. Next, fasteners, such as screws 26, are passed through holes in vertical support member 20 and driven into the wall surface 21 as shown in FIG. 2. Finally, paper roll 12 is reinstalled.

Toilet paper appliance 10 can accommodate dispensers of the C-clamp type. C-clamp dispensers having a straight member connected to the two posts of the dispenser 14 are well know in the art. The appliance 10 can be fastened to the wall surface 21 with the same screws 26 used to install the C-clamp dispenser 14 by joining the appliance 10 with the dispenser 14 as shown in FIG. 1. Either the appliance 10 or the dispenser 14 may contact the surface of the wall.

Figure 3:
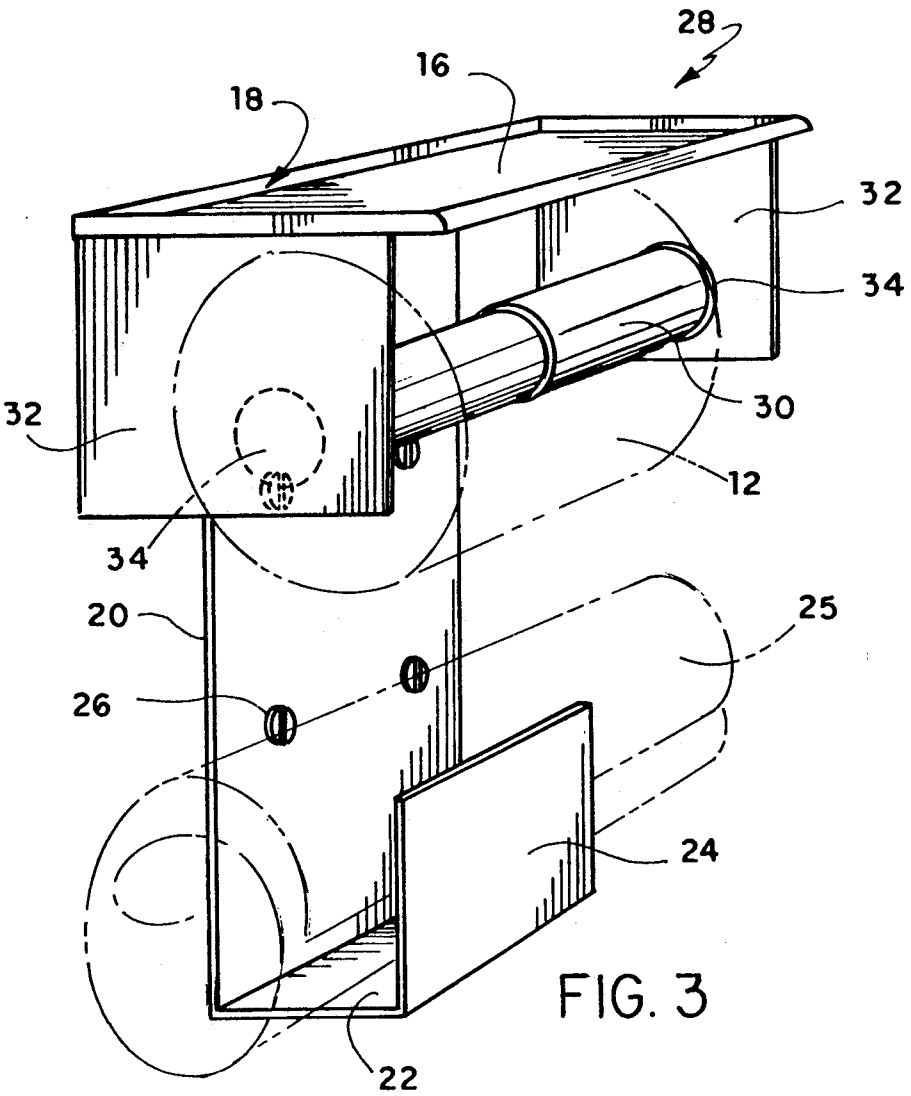
FIG. 3 is an environmental perspective view of a second embodiment of a toilet paper appliance in accordance with the present invention.

A second embodiment 28 of the present invention is shown in FIG. 3. Vertical hangers 32 are added to the embodiment shown in FIG. 1 for supporting a roll of toilet paper 12. The second embodiment 28 obviates the need for a separate toilet paper dispenser. The vertical hangers 32 are attached at right angles to the underside of shelf 16 and have circular grooves 34 for retaining a dowel 30 used to support a roll of toilet paper 12. Grooves 34 are positioned in vertical hangers 32 a suitable distance from the underside of shelf 16 to accommodate a standard roll of toilet paper 12. The dowel 30 may be a telescoping spindle well known in the art. Again, vertical support member 20 is of sufficient height to provide clearance between the printed material in the newspaper rack and the toilet paper roll 12.

The components that comprise the toilet paper appliance 10, 28 may be made of any desired material, such as acrylic plastic, metal or wood. To aid in fastening the appliance to a surface or wall, adhesives may be used as an additional or separate fastener for securing the appliance to a wall.

It is to be understood that the present invention is not limited to the embodiments described above, but encompasses any and all embodiments within the scope of the following claims.

I claim:

1. A toilet paper appliance usable with a toilet paper dispenser having at least two parallel means for supporting toilet paper located a fixed distance apart and extending perpendicular from a wall, said toilet paper appliance comprising:

a horizontal shelf;

a vertical support member having a width which is less than said fixed distance and joined to said horizontal shelf, including means for fastening said vertical support member to said wall; and a rack joined to the bottom of said support member, said rack being capable of holding a newspaper; whereby an intermediate portion of said vertical support member may be located between said at least two parallel means for supporting toilet paper thereby to locate said horizontal shelf above said toilet paper dispenser and said rack below said toilet paper dispenser.

2. The appliance according to claim 1, wherein said means for fastening includes holes enabling said appliance to be fastened to a wall.

3. The appliance according to claim 1, wherein said rack includes:

a horizontal member joined to the bottom of said vertical support member; and, a vertical retainer joined to said horizontal member.

4. The appliance according to claim 1, wherein the horizontal shelf has a raised bead.

5. An appliance for dispensing toilet paper and retaining printed material and other articles above the ground, comprising:

a horizontal shelf;

a plurality of vertical hangers located a fixed distance apart joined to the underside of said shelf to support a toilet paper roll;

a vertical support member having a width less than said fixed distance and joined to said shelf and mounted on a wall; and a rack joined to the bottom of said support member, said rack capable of holding a newspaper.

6. The appliance according to claim 5, wherein each vertical hanger has a circular groove on an inner surface thereof to enable support of said toilet paper roll.

7. The appliance according to claim 6, further including a toilet paper dowel coacting with each said circular groove to support said toilet paper roll.

8. The appliance according to claim 7, wherein said toilet paper dowel telescopes.

9. The appliance according to claim 5, wherein said vertical support member has holes therein enabling said appliance to be fastened to a wall.

10. The appliance according to claim 5, wherein said rack includes:

a horizontal member joined to the bottom of said vertical support member; and, a vertical retainer joined to said horizontal member.

11. The appliance according to claim 5, wherein said horizontal shelf has a raised bead.

12. An appliance for dispensing toilet paper and retaining printed material and other articles above ground, comprising:

a toilet paper dispenser of the type having a pair of forwardly extending arm members located a fixed distance apart for supporting a toilet paper roll;

a vertical support member having a width less than said fixed distance and placed between said arm members of said toilet paper dispenser and mounted on a wall;

a horizontal shelf joined to the top of said vertical member; and a rack joined to the bottom of said support member, said rack capable of holding a newspaper.

13. The appliance according to claim 12, wherein said vertical support member has holes therein thereafter said appliance to be fastened to a wall.

14. The appliance according to claim 12, wherein said rack includes:

a horizontal member joined to the bottom of said vertical support member; and, a vertical retainer joined to said horizontal member.

15. The appliance according to claim 12, wherein said horizontal shelf has a raised bead.

* * * * *